US006967300B1

(12) United States Patent
Mizuno et al.

(10) Patent No.: US 6,967,300 B1
(45) Date of Patent: Nov. 22, 2005

(54) KEY ASSEMBLY FOR ELECTRONIC MACHINES

(75) Inventors: Yuji Mizuno, Chula Vista, CA (US); Minh Nguyen, Chula Vista, CA (US)

(73) Assignee: SMK Manufacturing, Inc., Chula Vista, CA (US)

( * ) Notice: Subject to any disclaimer, the term of this patent is extended or adjusted under 35 U.S.C. 154(b) by 0 days.

(21) Appl. No.: 10/952,736

(22) Filed: Sep. 30, 2004

(51) Int. Cl.[7] ..... H01H 1/10

(52) U.S. Cl. ..... 200/512; 200/517; 200/518

(58) Field of Search ..... 200/5 A, 406, 200/512–518; 338/71, 128, 185

(56) References Cited

U.S. PATENT DOCUMENTS 6,313,731 B1 11/2001 Vance

FOREIGN PATENT DOCUMENTS

JP 2002-124154 4/2002

*Primary Examiner*—Ramon M. Barrera
(74) *Attorney, Agent, or Firm*—Westerman, Hattori, Daniels & Adrian, LLP

(57) ABSTRACT

A key assembly has a circuit board, an elongated flexible key, and an elastically deformable support. The flexible key has a center and two side portions. The side portions and the elastically deformable support each have electrically conductive regions that are positioned over electrical contacts of the circuit board. A sufficient downward force on the flexible key causes one of the electrically conductive regions to contact the underlying electrical contacts. With this configuration, the key assembly provides an electrical output signal even if the human operator applies the downward force on a side portion instead of on the center portion of the flexible key shell.

18 Claims, 9 Drawing Sheets

KEY ASSEMBLY FOR ELECTRONIC MACHINES

BACKGROUND OF THE INVENTION

Human/machine interfaces for electronic machines commonly include key assemblies or arrays thereof that convert a human operator's mechanical input into an electrical output. The key assembly arrays are typically part of keyboards for computers and part of keypads for telephones, calculators, and mobile game devices. The key assembly arrays may also be used in television and/or entertainment center remote control transmitters. Many other electronic machines also use such key assemblies.

Iwasaki (Japanese Laid-Open (Kokai) Patent Publication No. 2002-124154) discloses a key assembly that provides the human operator with tactile feedback in response to human input. The key assembly employs elastically deformable domes that support conductive regions on their undersides. The human operator forces a rigid key down on the top side of the elastically deformable domes to cause the domes to deform so that the underlying conductive regions descend onto electrical contacts of a circuit board to cause current to flow as output. During the transition of the rigid key from its uppermost to its lowermost position, the elastically deformable domes snap to provide a tactile response to the operator as an indication that the electrical output has been produced.

It is desirable that a key assembly provide a single tactile response to an operator's input, but the Iwasaki key assembly referenced above has multiple deformable domes that thereby provide more than a single response. A key assembly with a single elastically deformable dome will provide a single response and also reduce the number of components of the total assembly.

The use of a flexible key instead of a rigid key further reduces the number of components, because a flexible component accompanying a rigid key is no longer needed. FIGS. 1–4 illustrate a key assembly 20 comprising a flexible key 25, and, in a fashion analogous to that of Iwasaki, the flexible key 25 interacts with an elastically deformable support 30 and a circuit board 35 to produce an electrical output.

As shown, for example, in the side view of FIG. 1, the circuit board 35 has a pair of electrical contacts 40 on an exposed section 45 of its upper surface. The top view of FIG. 2 shows that the flexible key 25 is elongated. Such a design is typical for a computer keyboard "shift" key or "space" key. The elongated flexible key 25 has a center portion 50 and first and second side portions 55, 60. The center portion 50 has a center downwardly-extending protrusion 65.

The elastically deformable support 30 has a dome shape, and it supports an electrically conductive region 70 on its underside. The electrically conductive region 70 overlies the pair of electrical contacts 40 of the circuit board 35. The elastically deformable support 30 is positioned under the center portion 50 of the flexible key 25. With reference to FIG. 2, the outer dashed-line circle 75 represents the cross-sectional area of the elastically deformable support 30, and the inner dashed-line circle 80 represents the cross-sectional area of the electrically conductive region 70.

FIG. 1 illustrates the key assembly 20 of prior art under a condition in which the electrically conductive region 70 of the elastically deformable support 30 does not contact the underlying pair of electrical contacts 40 of the circuit board 35. When the key assembly 20 is under this condition, the center position 50 of the flexible key 25 is in a state that will be called the "up position" in the context of the present disclosure.

In contrast, FIG. 3 shows the key assembly 20 under a condition in which the electrically conductive region 70 does contact the underlying pair of electrical contacts 40 of the circuit board 35, and thus an electrical output is produced. When the key assembly 20 is under this condition, the center position 50 of the flexible key 25 is in a state that will be called the "down position" in the context of the present disclosure. (The side portions 55, 60 also have "up" and "down positions," as discussed below.) The center portion 50 transitions from its up position to its down position when a human operator applies a downward force F of sufficient magnitude on an upper surface 85 of the center portion 50.

The key assembly 20 can include circuitry (not shown) operative to provide a digital output. The digital output of the circuitry indicates whether the center portion 50 of the flexible key 25 has transitioned from its up position to its down position. That is, the circuitry indicates whether the human operator has provided a mechanical input to the key assembly 20.

The key assembly 20 of the prior art cannot provide the electronic output as reliably if the downward force F on the upper surface of the flexible key 25 is not applied to the center portion 50. FIG. 4 illustrates the result of an operator applying a downward force F on an upper surface 90 of the second side portion 60 instead. The second side portion 60, which also has an up position and a down position, moves downward. However, the electrically conductive region 70 of the elastically deformable support 30 does not contact the pair of electrical contacts 40 of the circuit board 35 when the second side portion 60 is in the down position. Therefore, the circuitry does not provide a digital output that is indicative of the human input.

Thus, the burden is on the human operator to exercise care that the application of the downward force F on the flexible key 25 is not too far from the center portion 50. Otherwise, the key assembly 25 will not produce the desired electrical output.

SUMMARY OF THE INVENTION

When using key assembly of the present invention, the human operator does not have the same burden as when using the key assembly of the prior art discussed above. That is, a downward force on the key assembly will still provide an electrical signal indicative of human input, even if the operator does not apply the downward force on the center portion of the flexible key shell.

The present invention may be embodied as a key assembly for an electronic machine, the key assembly having a circuit board, a flexible key, and an elastically deformable support. The flexible key may be elongated. The circuit board has electrical contacts on an upper surface. The flexible key has a center portion and first and second side portions such that the first side portion has a first electrically conductive region on its underside that is positioned over a first pair of the electrical contacts of the circuit board and the second side portion has a second electrically conductive region on its underside that is positioned over a second pair of the electrical contacts of the circuit board. The elastically deformable support is designed to support a third electrically conductive region on its underside, the elastically deformable support mounted with the third electrically conductive region positioned over a third pair of the electrical contacts of the circuit board, and the elastically deformable support is also mounted below the center portion of the flexible key. Each of the center portion and first and second side portions of the flexible key has an "up position" and a "down position" such that, in the up position, the corresponding electrically conductive region does not contact the underlying pair of electrical contacts, and, in the down position, the corresponding electrically conductive region does contact the underlying pair of electrical contacts. The flexible key is responsive to a downward force such that a sufficient downward force acting on an upper surface of the center portion causes the center portion to transition from its up position to its down position, a sufficient downward force acting on an upper surface of the first side portion causes the first side portion to transition from its up position to its down position, and a sufficient downward force acting on an upper surface of the second side portion causes the second side portion to transition from its up position to its down position.

The present invention has additional aspects. For example, the key assembly discussed in the preceding paragraph may include circuitry operative to provide a digital output limited to only a first value and a second value as follows: the first value indicates that one of the center and first and second side portions has transitioned from its up position to its down position, and the second value indicates that none of the center and first and second side portions has transitioned from its up position to its down position.

Also, the elastically deformable support may have a dome shape. For example, the elastically deformable support may be a polydome or a metal dome.

Additionally, the center portion of the flexible key may have a center downwardly-extending protrusion, the first side portion of the flexible key may have a first side downwardly-extending protrusion, and the second side portion of the flexible key may have a second side downwardly-extending protrusion.

As another aspect of the present invention, the circuit board may be a printed wire board or an FPC.

The present invention may also be embodied as a key assembly array for an electronic machine. The key assembly array may include the key assembly summarized above.

The present invention may further be embodied as an electronic machine. The electronic machine may include the key assembly summarized above.

The present invention is described in detail below with reference to the accompanying drawings, which are briefly described as follows:

DETAILED DESCRIPTION OF THE INVENTION

The invention summarized above and defined by the claims below may be better understood by referring to the present detailed description, which should be read with reference to the accompanying drawings. This detailed description presents embodiments of the present invention. This description is not intended to limit the scope of claims but instead to provide an example of the invention.

Figure 1:
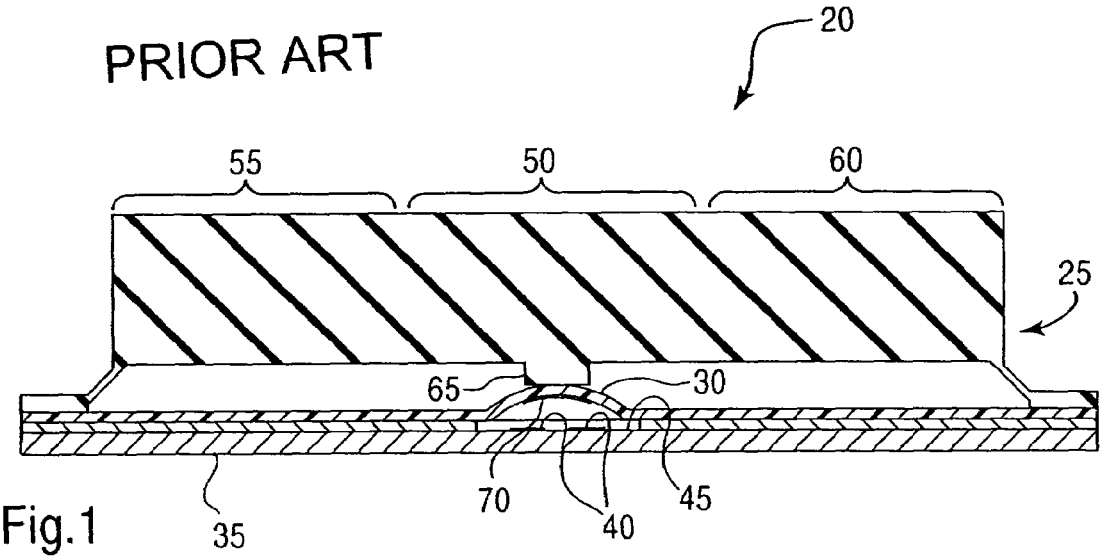
FIG. 1 is a side view of the key assembly of the prior art.
Figure 2:
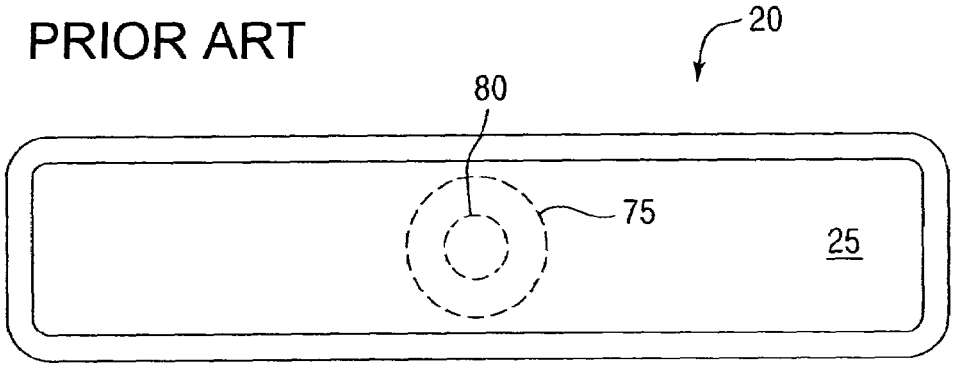
FIG. 2 is a top view of the key assembly of FIG. 1.
Figure 3:
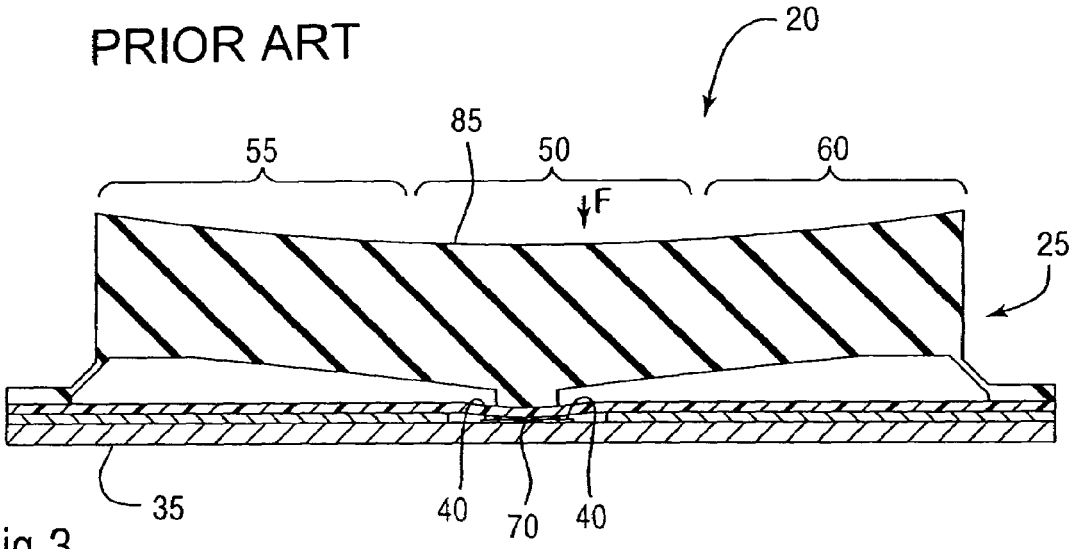
FIG. 3 is a side view of the key assembly of FIGS. 1 and 2, showing the result of a downward force acting on the center portion the elongated flexible key.
Figure 4:
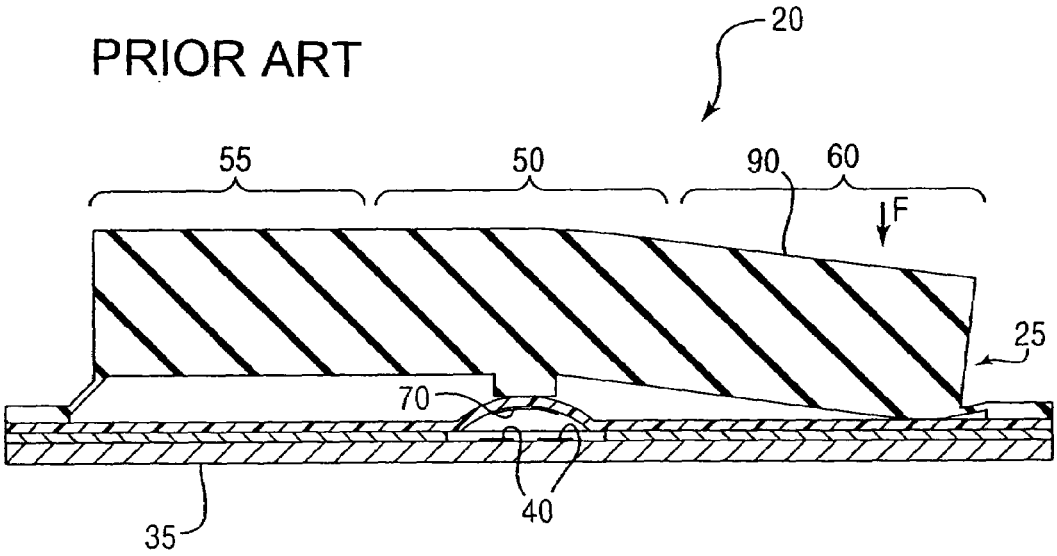
FIG. 4 is a side view of the key assembly of FIGS. 1 and 2, showing the result of a downward force acting on a side portion the elongated flexible key.
Figure 5:
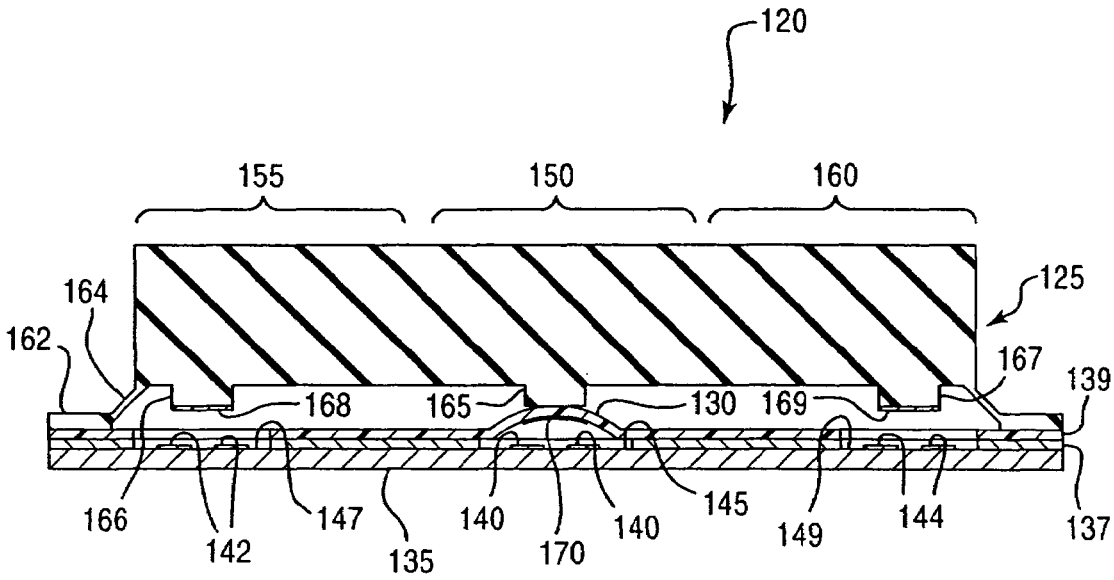
FIG. 5 is a side view of one embodiment of the key assembly of the present invention.

FIGS. 5–8 (excluding FIGS. 6*a*–6*c*) illustrate one embodiment of the key assembly of the present invention. With reference to FIG. 5, for example, a key assembly 120 comprises a flexible key 125, which interacts with an elastically deformable support 130 and a circuit board 135 to produce an electrical output. These elements can work in conjunction with circuitry (not shown) that is operative to provide a digital output indicative of human input, as discussed in more detail below.

The circuit board 135 in this embodiment is a printed wire board. In alternative embodiments, the circuit board may be any other equivalent means for maintaining electrical contacts in a plane in fixed positions. One example of an equivalent of the printed wire board is a flexible printed circuit (FPC).

The circuit board 135 has thereon a spacer layer 137 and a polydome layer 139 (discussed below) covering a substantial area of the upper surface of the circuit board 135. Three pairs of electrical contacts 140, 142, 144 are positioned on exposed sections 145, 147, 149, respectively, of the circuit board 135. That is, the electrical contacts 140, 142, 144 are not covered by the spacer layer 137 and the polydome layer 139.

In the present embodiment, the flexible key 125 of the key assembly 120 is elongated, as shown in the top view of FIG. 6, but the invention is not limited to key assemblies that have elongated flexible keys, as discussed below. The elongated flexible key 125 has a center portion 150 and first and second side portions 155, 160. A base portion 162 (not shown in FIG. 6) of the flexible key 125 is attached to the circuit board 135 (through intermediate layers in this embodiment, as discussed above), and a flexible skirt portion 164 of the flexible key 125 joins the base portion 162 to the remainder of the flexible key 125.

In the present embodiment, the center portion 150 of the flexible key 125 has a center downwardly-extending protrusion 165, the first side portion 155 has a first side downwardly-extending protrusion 166, and second side portion 160 has a second side downwardly-extending protrusion 167. However, the invention is not limited only to flexible keys that have such downwardly-extending protrusions.

The elongated flexible key 125 has electrically conductive regions as follows: The first side portion 155 has a first electrically conductive region 168 on its underside that is positioned over one side pair of electrical contacts 142 of the circuit board 135, and the second side portion 160 has a second electrically conductive region 169 on its underside that is positioned over the other side pair of electrical contacts 144.

As an alternative to the elongated flexible key 125 of the depicted embodiment, the key assembly of the present invention may have any other equivalent means for positioning a first electrically conductive region over one side pair of electrical contacts of the circuit board and for positioning a second electrically conductive region over another side pair of said electrical contacts of the circuit board. For example, the flexible key may have a square cross-section, as shown in FIG. 6*a*, or a circular cross-section, as shown in FIGS. 6*b* and 6*c* (discussed in more detail below). Also, in the present embodiment, the elongated flexible key 125 is formed from rubber, although equivalent materials are within the scope of the invention.

In the featured embodiment, the elastically deformable support 130 has a dome shape, although the present invention is not limited to an elastically deformable support of such shape. The dome-shaped elastically deformable support of the featured embodiment is part of a polymer sheet that forms the polydome layer 139. An individual elastically deformable support is often referred to as "polymer-sheet dome" or simply as "polydome." An array of polydomes may be formed on the polymer sheet to provide the elastically deformable supports for an array of key assemblies.

The elastically deformable support 130 supports a third electrically conductive region 170 on its underside. The third electrically conductive region 170 overlies the pair of electrical contacts 140 of the circuit board 135. The elastically deformable support 130 is positioned under the center portion 150 of the flexible key 125.

As an alternative to the elastically deformable support 130 of the depicted embodiment, the key assembly of the present invention may have equivalent means for supporting a third electrically conductive region over the center pair of electrical contacts of the circuit board. For example, instead of implementing a polydome with an electrically conductive region attached as a separate element, it is within the general scope of the invention that the elastically deformable support itself may be the electrically conductive region, as is the case with metal domes.

Figure 6:
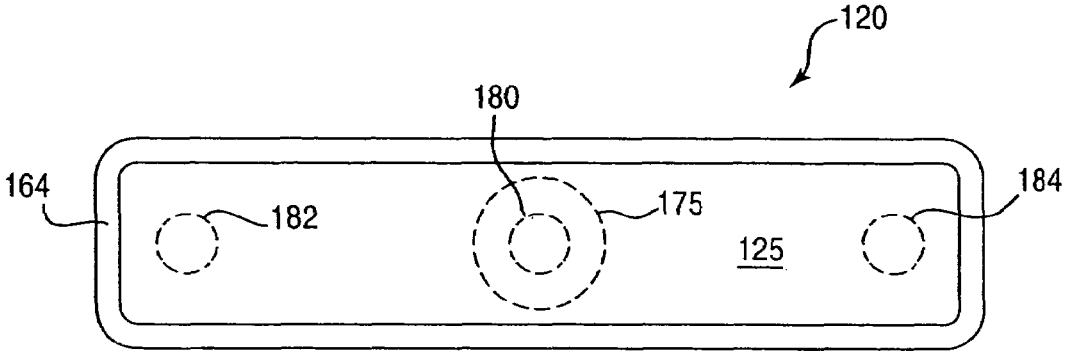
FIG. 6 is a top view of the key assembly of FIG. 5.
Figure 6A:
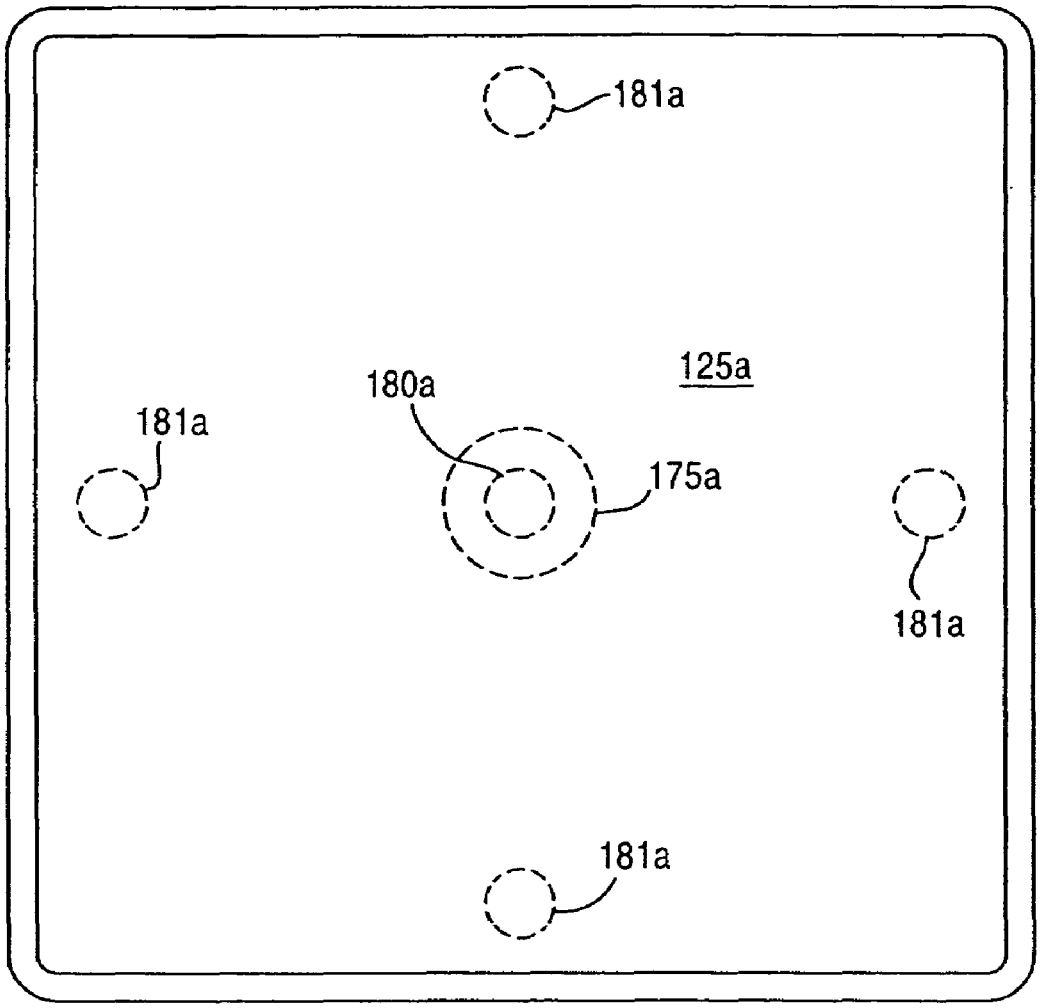
FIG. 6*a* is a top view of an alternative embodiment of the key assembly of the present invention.
Figure 6B:
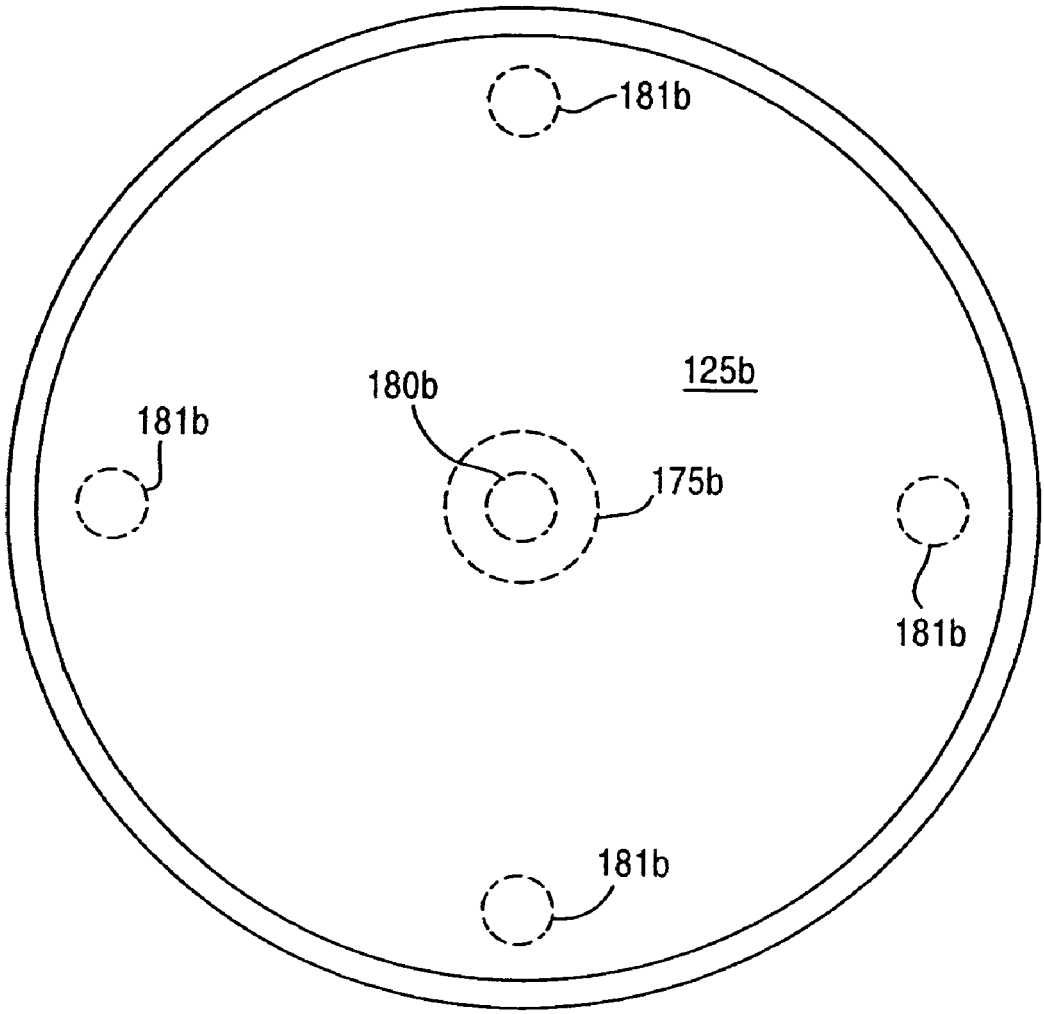
FIG. 6*b* is a top view of another alternative embodiment of the key assembly of the present invention.
Figure 6C:
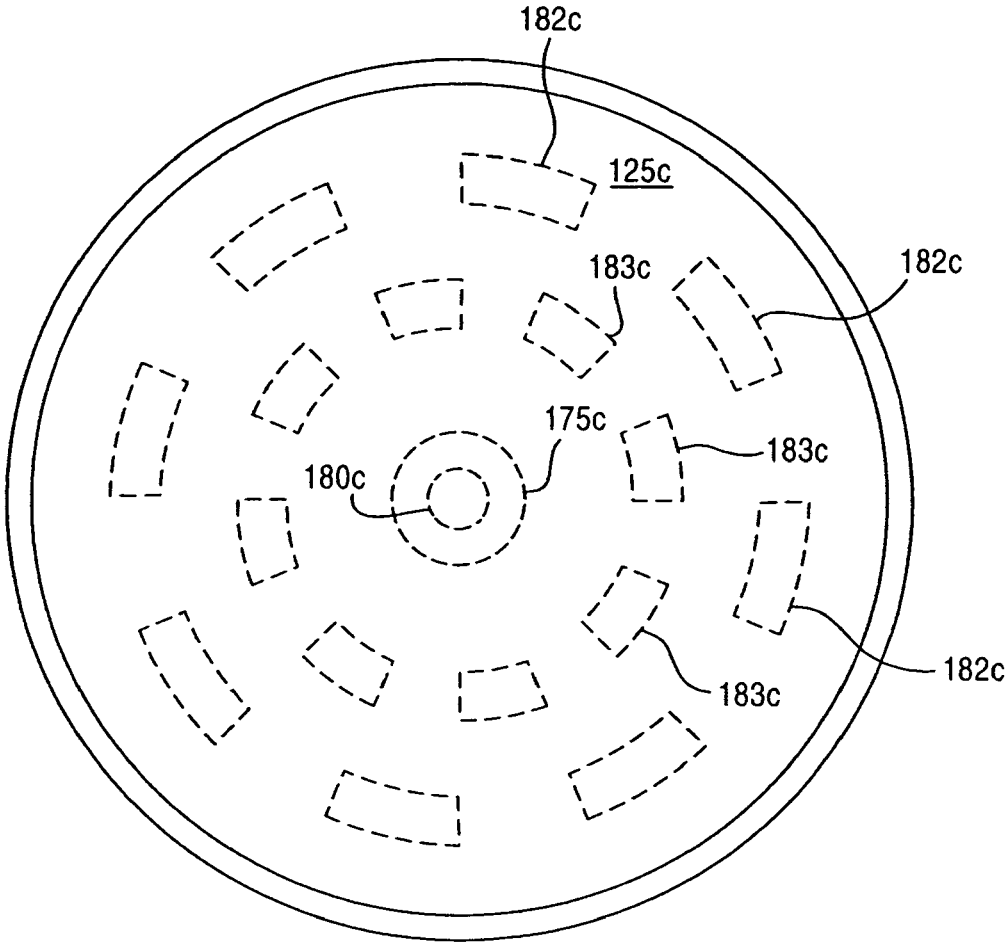
FIG. 6*c* is a top view of still another alternative embodiment of the key assembly of the present invention.

With reference to FIG. 6, the outer dashed-line circle 175 represents the cross-sectional area of the elastically deformable support 130, and the inner dashed-line circle 180 represents the cross-sectional area of the third electrically conductive region 170. The dashed-line circle 182 represents the cross-sectional area of the first electrically conductive region 168, and the dashed-line circle 184 represents the cross-sectional area of the second electrically conductive region 169.

FIG. 5 illustrates the key assembly 120 under a condition in which the third electrically conductive region 170 of the elastically deformable support 130 does not contact the underlying pair of electrical contacts 140 of the circuit board 135. When the key assembly 120 is under this condition, the center position 150 of the flexible key 125 is in the state that is called the "up position" in the context of the present disclosure.

Figure 7:
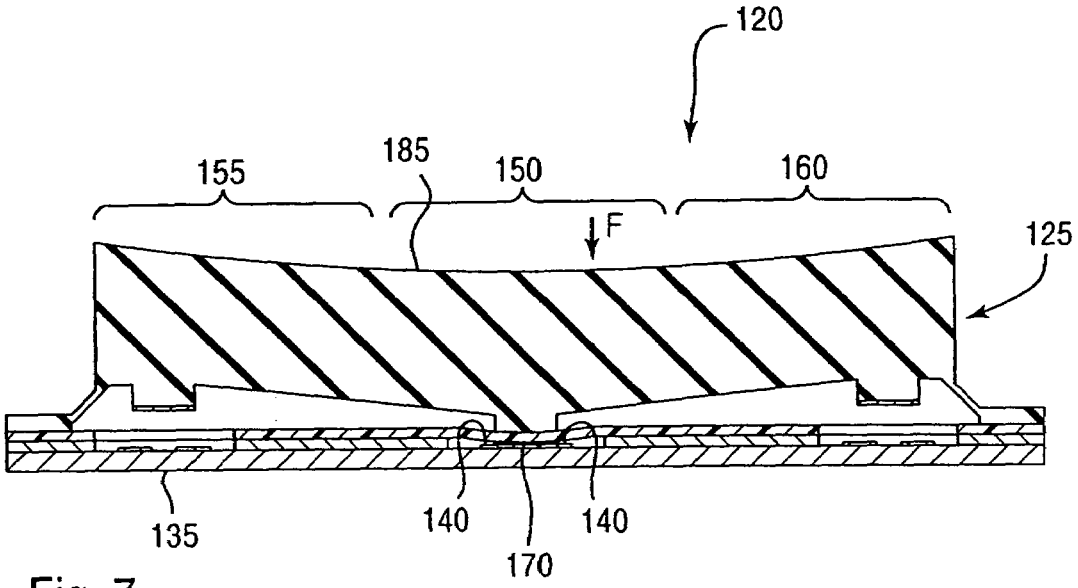
FIG. 7 is a side view of the key assembly of FIGS. 5 and 6, showing the result of a downward force acting on the center portion the elongated flexible key.

In contrast, FIG. 7 shows the key assembly 120 under a condition in which the third electrically conductive region 170 does contact the underlying pair of electrical contacts 140 of the circuit board 135, and thus an electrical output is produced. When the key assembly 120 is under this condition, the center position 150 of the flexible key 125 is in the state that is called the "down position" in the context of the present disclosure. (The side portions 155, 160 also have "up" and "down positions," as discussed below.) The center portion 150 transitions from its up position to its down position when a human operator applies a downward force F of sufficient magnitude on an upper surface 185 of the center portion 150.

That the terms "up" and "down" are used in the present disclosure to indicate the absence and presence, respectively, of contact between an electrically conductive region and a pair of electrical contacts of the circuit board. However, no representation is made that the key assembly is only operative when it is oriented such that the direction of movement of the portions of the flexible key is vertical. The key assembly of the present invention may be affixed to a vertical surface, such as in the case of key assemblies of some wall-mounted telephones, so the direction of movement of the portions of the flexible key is horizontal. As with the featured embodiment, the "up" and "down" positions are indicative of whether an electrically conductive region contacts a pair of electrical contacts of the circuit board. For this reason, the relative positions of the electrically conductive regions 168, 169, 170 can also be described as "up" or "down positions" to indicate absence or presence, respectively, of contact with the underlying pair of electrical contacts.

Figure 8:
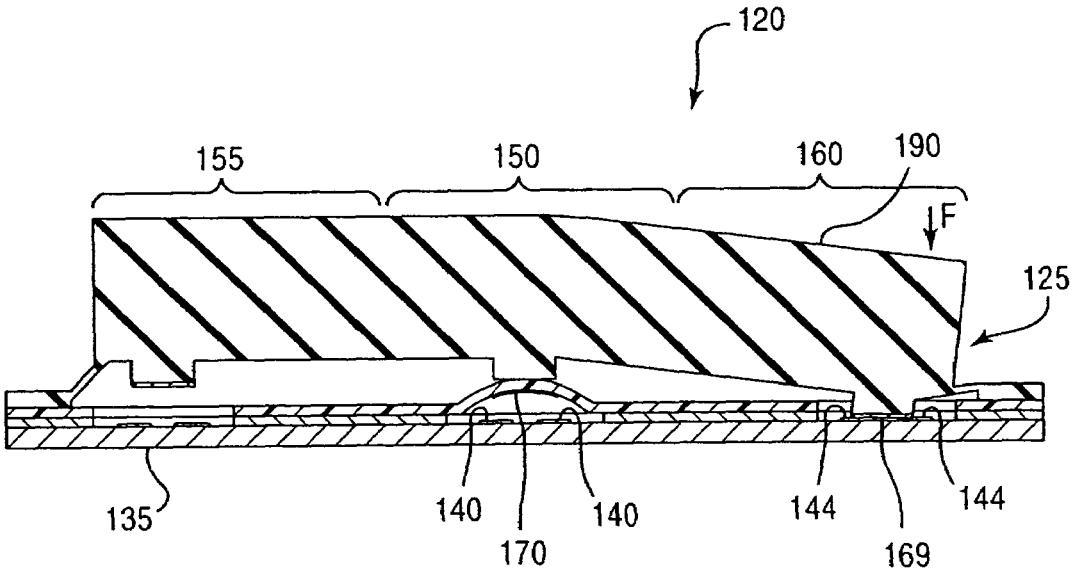
FIG. 8 is a side view of the key assembly of FIGS. 5 and 6, showing the result of a downward force acting on a side portion the elongated flexible key.

The key assembly 120 of the present invention is able to provide an electronic output even when the downward force F that the human operator applies on the upper surface of the flexible key 125 is not applied to the center portion 150 thereof. FIG. 8 illustrates the result of an operator applying a downward force F on an upper surface 190 of the second side portion 160 instead. The second side portion 160 of the flexible key 125 moves downward. That is, the second side portion 160 transitions from its "up position" to its "down position." Therefore, although the third electrically conductive region 170 does not contact the underlying center pair of electrical contacts 140, the second electrically conductive region 169 does contact the underlying side pair of electrical contacts 144, and thus an electrical output is produced. Thus, by utilizing the key assembly 120 of the present invention, the human operator does not need to devote so much effort to ensure that the downward force on the flexible key 125 is applied close to the center portion 150.

The key assembly 120 may include circuitry (not shown) operative to provide a digital output. The digital output indicates whether any of the center portion 150 and the first and second side portions 155, 160 of the flexible key 125 has transitioned from its up position to its down position. That is, the circuitry indicates whether the human operator has provided a mechanical input to the key assembly 120.

The circuitry may also be designed to provide a digital output that is limited to only a "first value" and a "second value" as follows: the first value indicates that one of the center and first and second side portions 150, 155, 160 has transitioned from its up position to its down position, and said second value indicates that none of the center and first and second side portions 150, 155, 160 has transitioned from its up position to its down position. The key assembly of the present invention does not require that the circuitry provide additional information, such as which of the center and first and second side portions 150, 155, 160 has transitioned from its up position to its down position.

For this reason, the circuit board 135 may be designed to have two groups of electrical contacts as follows: The first group of electrical contacts has one electrical contact from each of pairs 140, 142, 144, and all electrical contacts in the first group are electrically connected together. The second group of electrical contacts has the other electrical contacts from the pairs 140, 142, 144, and the electrical contacts of the second group are also all electrically connected together. With such a design, the circuitry would provide a single digital output of the second value if more than one of the center and first and second side portions 150, 155, 160 transition at the same time to the down position.

As an alternative to the circuitry discussed above, the key assembly of the present invention may include instead equivalent means for providing a digital output that is limited to only a first value or a second value.

As mentioned above, the flexible key of the present invention may have a square cross-section or a circular cross-section. FIGS. 6*a*–6*c* illustrate these configurations as follows:

FIG. 6*a* illustrates top view of a flexible key 125*a* having a square cross-section. The center outer dashed-line circle 175*a* represents the cross-sectional area of an underlying elastically deformable support, and the center inner dashed-line circle 180*a* represents the cross-sectional area of an electrically conductive region on the underside of the flexible key 125*a*. The four dashed-line circles 181*a* represent the cross-sectional areas of electrically conductive regions positioned at the periphery of the flexible key 125*a*.

FIG. 6*b* illustrates a flexible key 125*b* having a circular cross-section. The center outer dashed-line circle 175*b* represents the cross-sectional area of an underlying elastically deformable support, and the center inner dashed-line circle 180*b* represents the cross-sectional area of an electrically conductive region on the underside of the flexible key 125*b*. The four dashed-line circles 181*b* represent the cross-sectional areas of electrically conductive regions positioned at the periphery of the flexible key 125*b*.

FIG. 6*c* illustrates a flexible key 125*c* that is another embodiment of a flexible key having a circular cross-section. The center outer dashed-line circle 175*c* represents the cross-sectional area of an underlying elastically deformable support, and the center inner dashed-line circle 180*c* represents the cross-sectional area of an electrically conductive region on the underside of the flexible key 125*c*. Instead of a series of circular electrically conductive regions positioned at the periphery, as in the configuration of the flexible key 125*b*, the flexible key 125*c* has a series of concentric electrically conductive regions 182*c* and 183*c* on its underside. As shown in FIG. 6*c*, electrically conductive regions 182*c* and 183*c* can each be configured as a set of circle segments.

Figure 9:
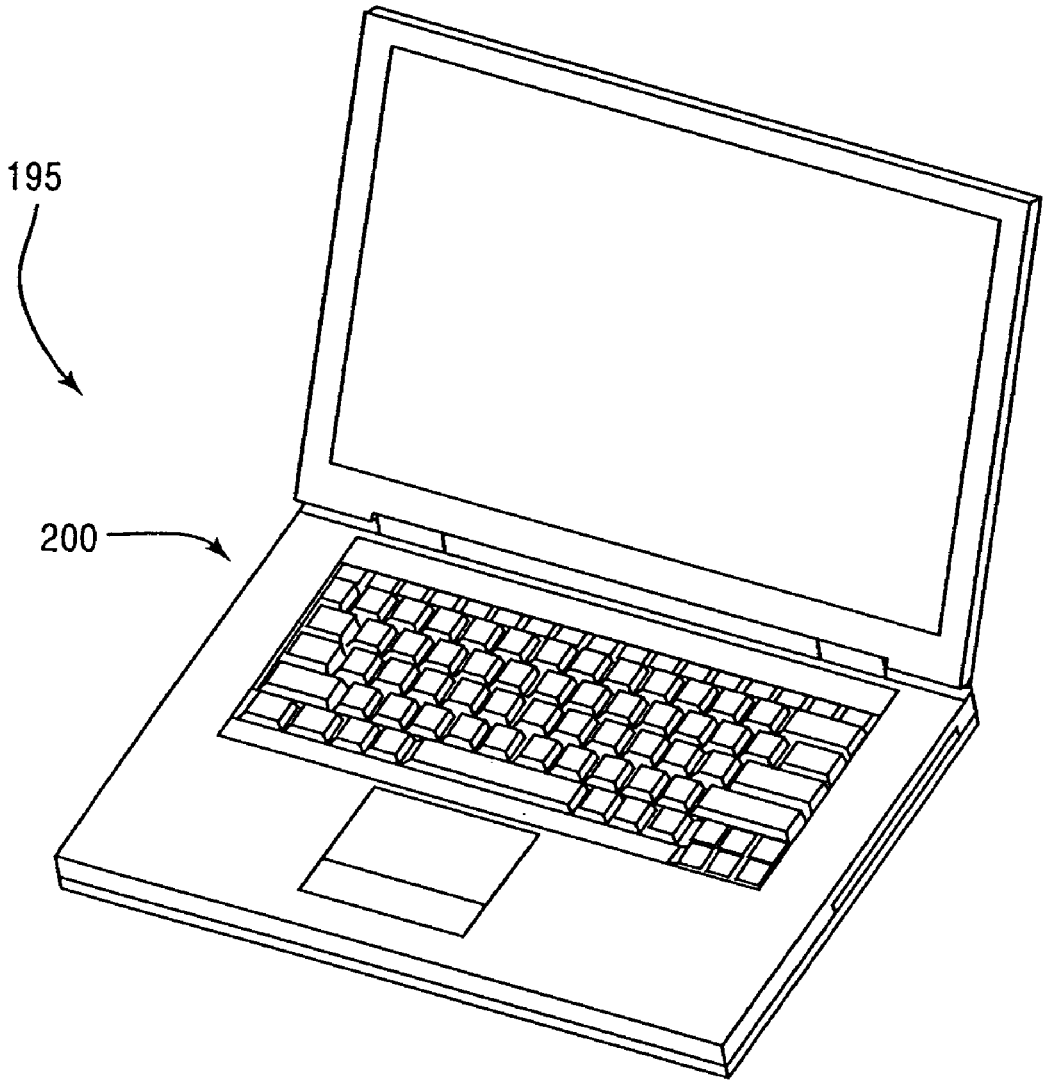
FIG. 9 is a perspective view of one embodiment of a laptop computer in accordance with the present invention.
Figure 10:
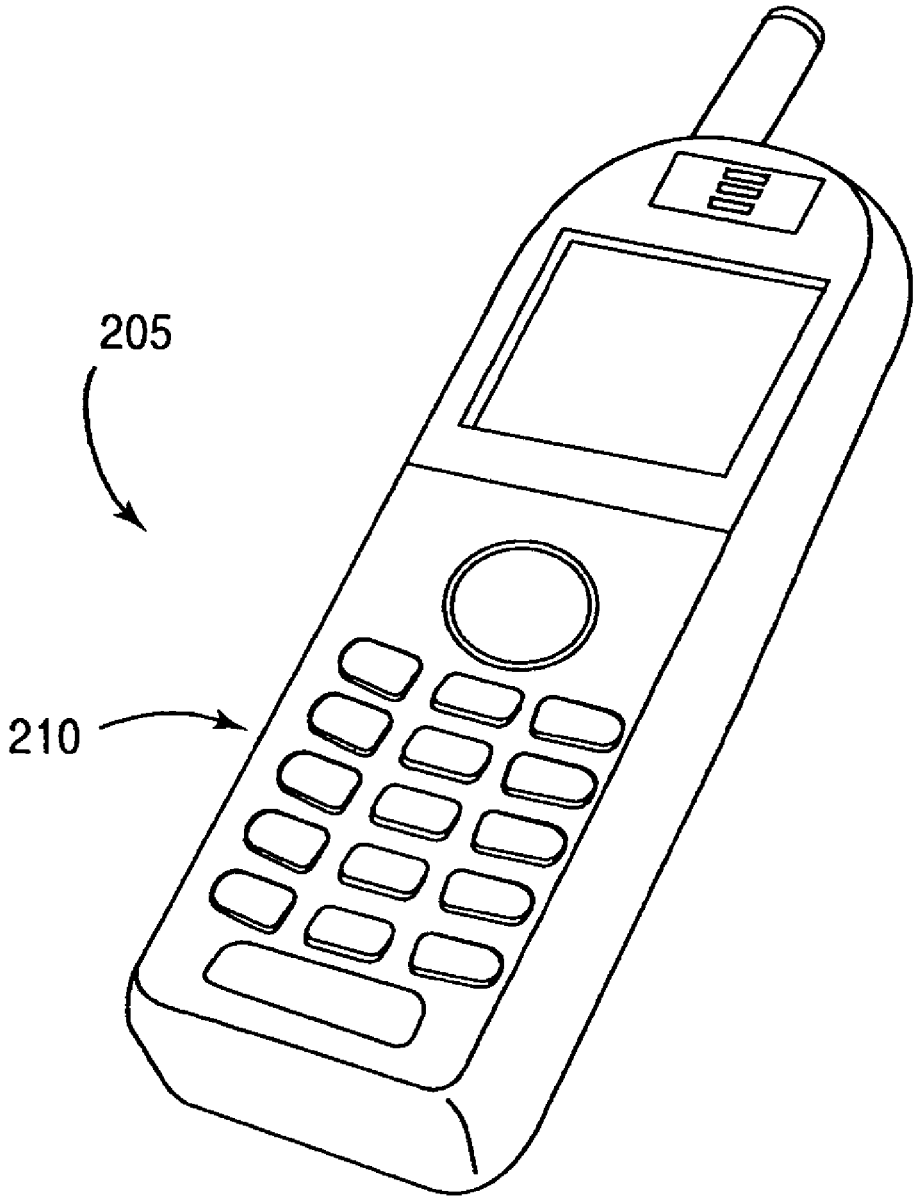
FIG. 10 is a perspective view of one embodiment of a radio telephone in accordance with the present invention.

Electronic machines designed in accordance with the present invention include computers, telephones, calculators, mobile game devices, remote control transmitters for television and/or entertainment centers, and the like. For example, FIG. 9 shows a laptop computer 195 having a key assembly array 200 with at least one of the key assemblies built in accordance with above-described features of the invention. As another example, FIG. 10 shows a radio telephone 205 having a key assembly array 210 with at least one of the key assemblies built in accordance with above-described features of the invention.

Having thus described an exemplary embodiment of the invention, it will be apparent that various alterations, modifications, and improvements will readily occur to those skilled in the art. For example, although the present invention has been described in the context of a human/machine interface, the scope of the invention encompasses a machine/machine interface, for example, a combination of the disclosed flexible key assembly adjacent a solenoid-activated linear actuator. Another example would be a robot activating the disclosed key assembly.

Alternations, modifications, and improvements of the disclosed invention, though not expressly described above, are nonetheless intended and implied to be within spirit and scope of the invention. Accordingly, the foregoing discussion is intended to be illustrative only; the invention is limited and defined only by the following claims and equivalents thereto.

We claim:

1. A key assembly for an electronic machine, said key assembly comprising:

a circuit board having electrical contacts on an upper surface;

an elongated flexible key having a center portion and first and second side portions, said first side portion having a first electrically conductive region on its underside that is positioned over a first pair of said electrical contacts of said circuit board and said second side portion having a second electrically conductive region on its underside that is positioned over a second pair of said electrical contacts of said circuit board; and an elastically deformable support that supports a third electrically conductive region on its underside, said elastically deformable support mounted with said third electrically conductive region positioned over a third pair of said electrical contacts of said circuit board, said elastically deformable support also mounted below said center portion of said flexible key, wherein each of said center portion and first and second side portions of said flexible key has an up position and a down position such that, in said up position, the corresponding electrically conductive region does not contact the underlying pair of electrical contacts, and, in said down position, the corresponding electrically conductive region does contact the underlying pair of electrical contacts, and wherein said flexible key is responsive to a downward force such that a sufficient downward force acting on an upper surface of said center portion causes said center portion to transition from its up position to its down position, a sufficient downward force acting on an upper surface of said first side portion causes said first side portion to transition from its up position to its down position, and a sufficient downward force acting on an upper surface of said second side portion causes said second side portion to transition from its up position to its down position.

2. The key assembly of claim 1, further comprising:

circuitry operative to provide a digital output limited to only a first value and a second value, said first value indicative of one of said center and first and second side portions transitioning from its up position to its down position, and said second value indicative of none of said center and first and second side portions transitioning from its up position to its down position.

3. The key assembly of claim 1, wherein said elastically deformable support has a dome shape.

4. The key assembly of claim 3, wherein said elastically deformable support is a polydome.

5. The key assembly of claim 3, wherein said elastically deformable support is a metal dome.

6. The key assembly of claim 1, wherein said center portion of said flexible key has a center downwardly-extending protrusion, said first side portion of said flexible key has a first side downwardly-extending protrusion, and said second side portion of said flexible key has a second side downwardly-extending protrusion.

7. The key assembly of claim 1, wherein said circuit board is a printed wire board.

8. The key assembly of claim 1, wherein said circuit board is an FPC.

9. A key assembly array for an electronic machine, said key assembly array comprising:

the key assembly of claim 1.

10. An electronic machine comprising:

the key assembly of claim 1.

11. A key assembly for an electronic machine, said key assembly comprising:

a circuit board having electrical contacts on an upper surface;

a flexible key having a center portion and first and second side portions, said first side portion having a first electrically conductive region on its underside that is positioned over a first pair of said electrical contacts of said circuit board and said second side portion having a second electrically conductive region on its underside that is positioned over a second pair of said electrical contacts of said circuit board;

an elastically deformable support that supports a third electrically conductive region on its underside, said elastically deformable support mounted with said third electrically conductive region positioned over a third pair of said electrical contacts of said circuit board, said elastically deformable support also mounted below said center portion of said flexible key; and circuitry operative to provide a digital output limited to only a first value and a second value, wherein each of said center portion and first and second side portions of said flexible key has an up position and a down position such that, in said up position, the corresponding electrically conductive region does not contact the underlying pair of electrical contacts, and, in said down position, the corresponding electrically conductive region does contact the underlying pair of electrical contacts, wherein said flexible key is responsive to a downward force such that a sufficient downward force acting on an upper surface of said center portion causes said center portion to transition from its up position to its down position, a sufficient downward force acting on an upper surface of said first side portion causes said first side portion to transition from its up position to its down position, and a sufficient downward force acting on an upper surface of said second side portion causes said second side portion to transition from its up position to its down position, and wherein said first value of said digital output is indicative of one of said center and first and second side portions transitioning from its up position to its down position, and said second value of said digital output is indicative of none of said center and first and second side portions transitioning from its up position to its down position.

12. The key assembly of claim 11, wherein said elastically deformable support has a dome shape.

13. The key assembly of claim 11, wherein said center portion of said flexible key has a center downwardly-extending protrusion, said first side portion of said flexible key has a first side downwardly-extending protrusion, and said second side portion of said flexible key has a second side downwardly-extending protrusion.

14. A key assembly array for an electronic machine, said key assembly array comprising:

the key assembly of claim 11.

15. An electronic machine comprising:

the key assembly of claim 11.

16. A key assembly for an electronic machine, said key assembly comprising:

a means for maintaining electrical contacts in a plane in fixed positions;

a means for positioning a first electrically conductive region over a first pair of said electrical contacts and for positioning a second electrically conductive region over a second pair of said electrical contacts;

a means for supporting a third electrically conductive region over a third pair of said electrical contacts, said means for supporting being mounted below a part of said means for positioning that is located between said first electrically conductive region and said second electrically conductive region; and means for providing a digital output limited to only a first value and a second value, wherein each of said first, second, and third electrically conductive regions has an up position and a down position such that, in said up position, the electrically conductive region does not contact the underlying pair of electrical contacts, and, in said down position, the electrically conductive region does contact the underlying pair of electrical contacts, and wherein said means for positioning is responsive to a downward force such that a sufficient downward force directed toward said first electrically conductive region causes the first electrically conductive region to transition from its up position to its down position, a sufficient downward force directed toward said second electrically conductive region causes the second electrically conductive region to transition from its up position to its down position, and a sufficient downward force directed toward said third electrically conductive region causes the third electrically conductive region to transition from its up position to its down position, and wherein said first value of said digital output is indicative of one of said first, second, and third electrically conductive regions transitioning from its up position to its down position, and said second value of said digital output is indicative of none of said first, second and third electrically conductive regions transitioning from its up position to its down position.

17. A key assembly array for an electronic machine, said key assembly array comprising:

the key assembly of claim 16.

18. An electronic machine comprising:

the key assembly of claim 16.

* * * * *